US008776355B2

(12) United States Patent
Reiman et al.

(10) Patent No.: US 8,776,355 B2
(45) Date of Patent: Jul. 15, 2014

(54) METHOD AND DEVICE FOR FIXING A FAUCET TO A MOUNTING

(75) Inventors: Hannu Reiman, Järvenpää (FI); Raimo Kaukinen, Nastola (FI); Esko Savolainen, Hollola (FI)

(73) Assignee: Oy Graana Finland AB, Akaa (FI)

( * ) Notice: Subject to any disclaimer, the term of this patent is extended or adjusted under 35 U.S.C. 154(b) by 288 days.

(21) Appl. No.: 13/320,359

(22) PCT Filed: May 7, 2010

(86) PCT No.: PCT/FI2010/050370

§ 371 (c)(1),
(2), (4) Date: Jan. 27, 2012

(87) PCT Pub. No.: WO2010/130874

PCT Pub. Date: Nov. 18, 2010

(65) Prior Publication Data

US 2012/0110826 A1 May 10, 2012

(30) Foreign Application Priority Data

May 15, 2009 (FI) ..... 20095543

(51) Int. Cl.

| | |
|---|---|
| ***B23P 11/00*** | (2006.01) |
| ***B23P 17/00*** | (2006.01) |
| ***E03C 1/04*** | (2006.01) |

(52) U.S. Cl.

USPC ..... 29/525.11; 29/890.141; 4/678; 4/670; 137/801; 248/212

(58) Field of Classification Search

USPC ..... 29/444, 522.1, 523, 525.11, 525.02, 29/890.141; 4/695, 670, 696, 675–678; 137/360, 801, 359; 403/373, 199, 403/408.11, 374.1, 374.2, 374.5, 367–371; 248/74.1, 74.3, 74.4, 212

See application file for complete search history.

(56) References Cited

U.S. PATENT DOCUMENTS

| | | | | |
|---|---|---|---|---|
| 2,804,559 | A * | 8/1957 | Brewer | 310/407 |
| 4,848,395 | A | 7/1989 | Krippendorf | |

(Continued)

FOREIGN PATENT DOCUMENTS

| | | |
|---|---|---|
| CN | 2542870 Y | 4/2003 |
| CN | 1521367 A | 8/2004 |

OTHER PUBLICATIONS

English translation of and Office Action dated May 24, 2013 for Application No. 2010800318048.

*Primary Examiner* — David Bryant
*Assistant Examiner* — Jun Yoo
(74) *Attorney, Agent, or Firm* — Ladas & Parry LLP

(57) ABSTRACT

The invention relates to a method and device for fixing a faucet to a mounting (1), such as a worktop or a sinktop. A fixing collar (2) is fastened to the top surface of a mounting by turning from above one or more set screws (3) extending from the fixing collar (2) over a distance below a bottom surface of the worktop. Turning of the screw is used for raising a clamping claw (4), which is in engagement with the threading of said set screw and which is steered by means of a guide (5) extending downward from the fixing collar and used for disallowing a rotation of the clamping claw (4) along with the set screw (3). The bottom end of a faucet body (10) or its extension is fastened around the fixing collar (2) by expanding the fixing collar (2) by an actuation means, such as a screw (8).

13 Claims, 2 Drawing Sheets

(56) References Cited

U.S. PATENT DOCUMENTS 5,464,045 A * 11/1995 Niemann et al. ..... 137/801
6,073,972 A * 6/2000 Rivera ..... 285/64
6,301,728 B1 10/2001 Pilatowicz et al.
6,334,226 B1 1/2002 Tokunaga et al.
8,079,381 B2 * 12/2011 Fischer et al. ..... 137/359

* cited by examiner

METHOD AND DEVICE FOR FIXING A FAUCET TO A MOUNTING

The invention relates to a method and device for fixing a faucet to a mounting, such as a worktop or a sinktop.

Prior known methods and devices necessitate working from under the mounting. Working space is scarce, making it uncomfortable to work with set screws and nuts, as well as a clamping claw. A heavy faucet present above the mounting is difficult to hold steady in a desired position during the fixing process. These are some of the reasons why the prior known fixing methods and devices require an installation time of considerable length.

It is an object of the invention to resolve the foregoing problems and to provide a method and device for fixing a faucet to a mounting, such that the installation work is significantly facilitated and the working time is substantially reduced, even to a fraction of what is required by prior known methods and devices.

This object is achieved in the invention by means of method steps presented in the appended claim 1, as well as by means of a fixing device presented in claim 2. The dependent claims disclose preferred embodiments of the invention.

The invention will now be described more closely with reference to the accompanying drawings, in which FIG. 1 shows a faucet fixing device of the invention in an immovably mounted position and in a vertical section;

Figure 1:
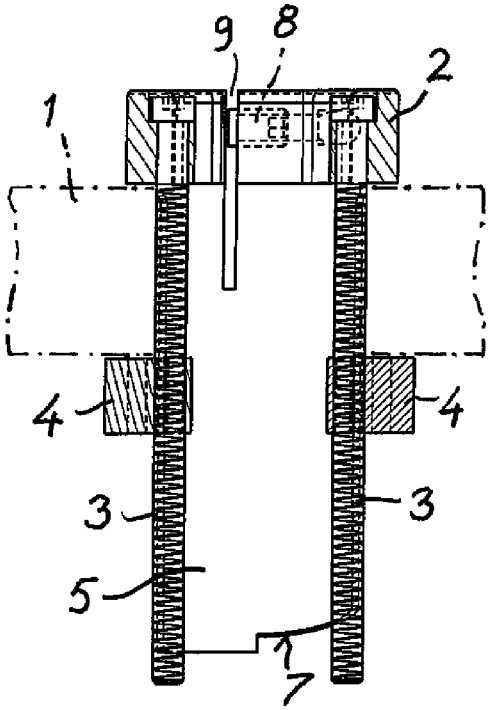
Figure 3:
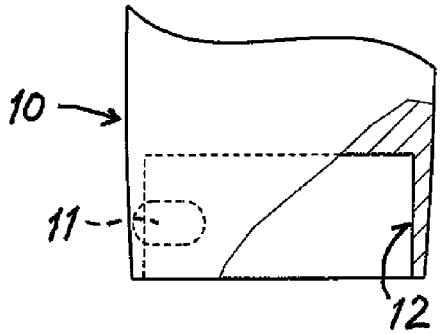
FIG. 3 shows the same fixing device in a position rotated by 90° with respect to the position of FIG. 1. A faucet ready for mounting is presented above the fixing device.
Figure 3:
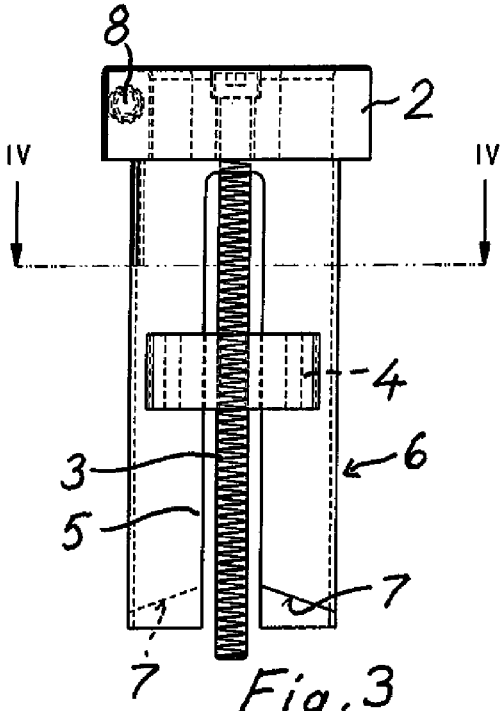
Figure 2:
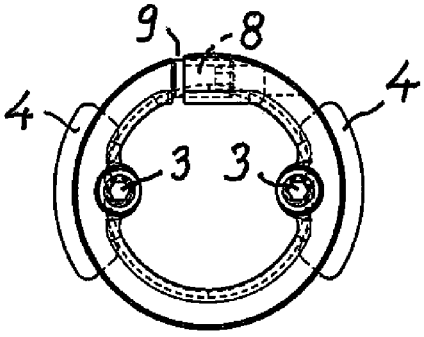
FIG. 2 shows the fixing device of FIG. 1 in a view from above.
Figure 4:
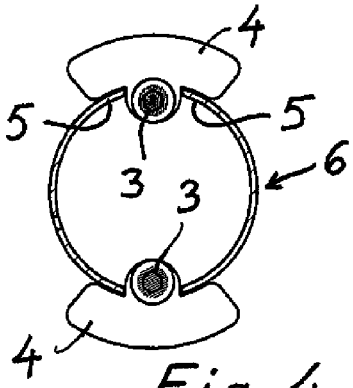
FIG. 4 shows a section along a line IV-IV in FIG. 3.

The fixing device includes a fixing collar 2, which is expansible with an actuation means 8 and attachable to a top surface of a mounting 1 by means of mounting elements to be subsequently described in more detail. In the present case, the fixing collar 2 is a split ring and the actuation means comprises a screw 8 capable of enlarging a splitting gap 9 for said expansion. The screw 8 can be replaced by hydraulic oil. Expansion of the fixing collar 2 can also be based on the use of rubber or elastomer, such as silicone.

The fixing collar 2 is cylindrical in its outer surface and has a height which is sufficient for providing a strong compression joint between the expanded fixing collar 2 and the lower end of a faucet body 10 or its extension. The faucet body 10 has its bottom end dimensioned (surface 12) to fit around the fixing collar 2 with a loose sliding fit before the fixing collar 2 is expanded.

The mounting elements for the fixing collar 2 include one or more top-clamping set screws 3, extending from the fixing collar 2 over a distance below a bottom surface of the mounting 1. An essential feature of the invention is the ability to rotate the set screws 3 from above. The set screws 3 have their top ends provided with appropriate engagement formations, such as hex sockets, e.g. for a power-drill operated tool.

The set screw 3 has its thread grabbed by a clamping claw 4, which is raisable by rotating the set screw 3. Alongside the set screw 3 is a guide 5 which disables rotation of the clamping claw 4 along with the set screw, whereby the clamping claw 4 rises to the position shown in FIG. 1 for pinching the mounting, such as a worktop or a sinktop, between the fixing collar 2 and the clamping claw 4. In a preferred case, the fixing device has two set screws 3, which are located on the opposite sides of a central opening of the fixing collar 2 and each of which is provided with its own clamping claw 4. The result is a strong and symmetrically balanced mounting.

In the illustrated case, the guide for the clamping claw 4 comprises a bush 6, which is associated with the fixing collar 2, extends downwards, and is smaller than the fixing collar in its outer diameter, and which is provided with a recess or slot whose edge constitutes the guide 5. Naturally, the guide may consist of any wire or rod located alongside the set screw 3 in a substantially parallel relationship therewith.

Figure 5:
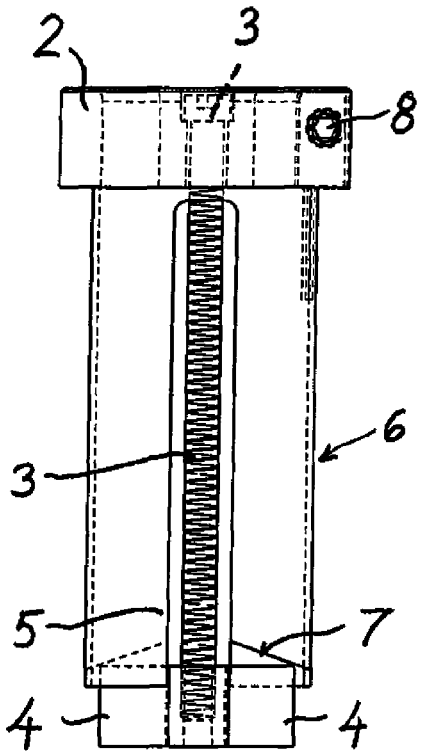
FIG. 5 shows a fixing device in a side view prior to a mounting operation, with clamping claws in a lead-in position.
Figure 7:
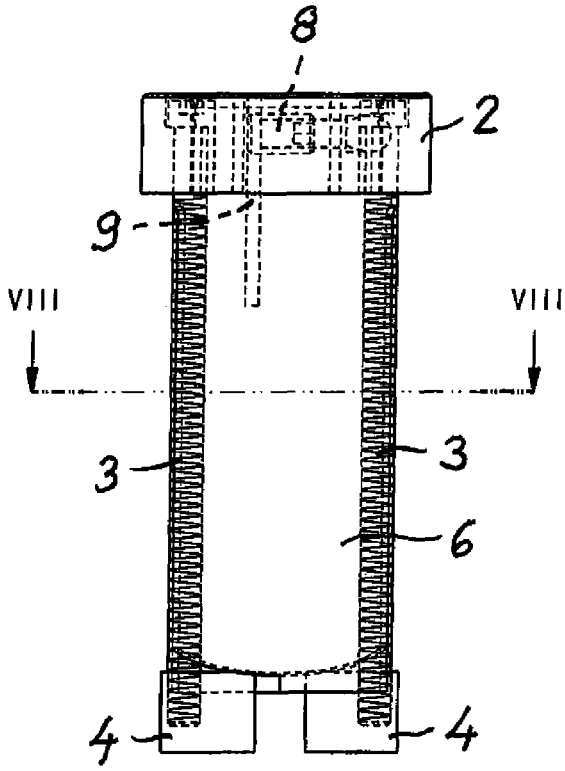
FIG. 7 shows the fixing device of FIG. 5 in a position rotated by 90°.
Figure 6:
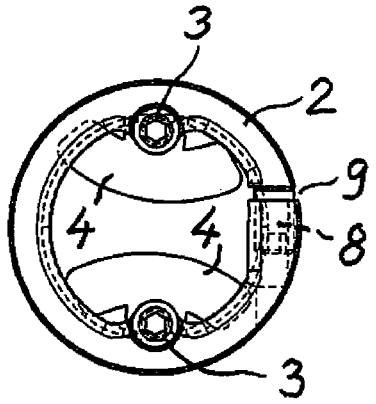
FIG. 6 shows the fixing device of FIG. 5 in a view from above.
Figure 8:
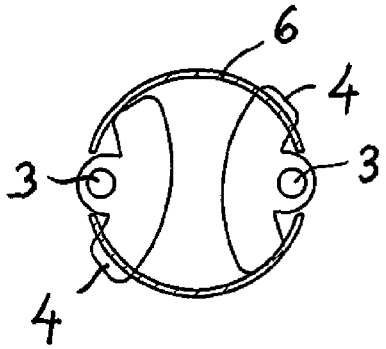
FIG. 8 shows a section along a line VIII-VIII in FIG. 7, illustrating the operating range of clamping claws in more detail.

In the illustrated preferred embodiment, the guide 5 has a formation 7 at its bottom end, allowing the clamping claw 4 present at the bottom end of the set screw 3 to rotate along with the set screw 3 from a lead-in position shown in FIG. 5, in which the clamping claws 4 are closer to a center axis of the fixing collar 2, to a clamping position shown in FIGS. 1-4, in which the clamping claws 4 are further away from the center axis and in which the clamping claws are held by said guide 5. The clamping claw 4 is an arcuate element, which has a central angle of 60°-120° and which lies essentially in its entirety on one side of the set screw 3, except for an internally threaded bracket engaging the set screw 3. This asymmetric disposition enables movements of the clamping claw 4 between the lead-in and clamping positions.

The faucet body 10 or its extension has its bottom end provided with a slot 11 (FIG. 3), by way of which the actuation means, such as a screw 8, capable of expanding the fixing collar 2, is workable for expanding the fixing collar 2, i.e. increasing its diameter. When using a fixing device of the invention, the mounting is performed in such a way that the fixing device is lead-in the position of FIGS. 5-8 into an installation aperture present in the mounting. This is followed by fastening the fixing collar 2 to a top surface of the mounting by threading from above the set screws 3, the clamping claws 4 turning first against the guides 5, followed by rising upward until colliding with a bottom surface of the mounting. The mounting 1 is retained between the fixing collar 2 and the clamping claws 4. The fixing device may include a direction arrow to indicate a rotated position for clamping the fixing device in order to have the faucet 10, subsequently attached to the fixing collar 2, pointing in the correct direction.

Thereafter, the faucet body 10 has its bottom end, or the faucet body 10 has an extension of its bottom end, placed upon the fixing collar 2, such that the slot 11 coincides with the head of the screw 8, after which, by rotating the screw 8, the fixing collar 2 is expanded to the engagement with a machined gripping surface 12. The surfaces pressing against each other can be cylindrical or, if desired, can be designed with various gripping formations. In tests, however, cylindrical surfaces have been found to achieve the necessary attachment strength many times over.

The term faucet means water faucet or water tap. The places of use of the invented faucets are mainly in kitchen and in bathroom.

The invention claimed is:

1. A device for fixing a faucet to a mounting having a hole therein, wherein the device comprises (a) a fixing collar having a top surface, a bottom surface and an outer surface, the fixing collar being disposable on the mounting in a mounting position wherein the fixing collar is disposed atop the hole in the mounting with a portion of the bottom surface of the fixing collar contacting a top surface of the mounting;

(b) a first fastening element or elements configured for extending through the fixing collar and through the hole in the mounting to below a bottom surface of the mounting when the fixing collar is disposed atop the hole in the mounting position; and (c) means, including a second fastening element or elements, for engaging with the first fastening element when the fixing collar is in the mounting position and the first fastening element or elements extend through the fixing collar and through the hole in the mounting to below the bottom surface of the mounting and for enabling the second fastening element or elements to be tightened against the bottom surface of the mounting by manipulation of the first fastening element or elements to fix the fixing collar to the mounting;

wherein the fixing collar is expansible upon actuation such that, with the fixing collar fixed to the top surface of the mounting in the mounting position, with a bottom end of a faucet body or an extension thereof disposed around the fixing collar and with actuation of the fixing collar, the outer surface of the fixing collar expands and presses against an inner surface of the faucet body or extension whereby to provide a compression joint between the fixing collar and the faucet body or extension that is sturdier than prior to expansion of the fixing collar and that fixes the faucet to the mounting.

2. The device according to claim 1, wherein the first fastening element includes at least one top-clamping set screw, and the means comprises a clamping claw in engagement with threading of the at least one set screw and a guide disposed alongside the at least one set screw for preventing rotation of the clamping claw when the set screw rotates.

3. The device according to claim 2, wherein the fixing collar comprises a split ring with a splitting gap that is enlargeable by screwing.

4. The device according to claim 2, wherein the fixing collar has a central opening and the first fastening elements comprise a plurality of set screws, including a first set screw and a second set screw, and the second fastening elements comprise a plurality of clamping claws, including a first clamping claw in engagement with the first set screw and a second clamping claw in engagement with the second set screw, wherein the first and second set screws are disposed on opposite sides of the central opening in the fixing collar.

5. The device according to claim 2, wherein the fixing collar further comprises a downward extending bush that includes a recess of slot having an edge that constitutes a guide for the clamping claw.

6. The device according to claim 2, wherein the guide comprises means for allowing the clamping claw, when disposed at a bottom end of the at least one set screw, to rotate along with the set screw from a lead-in position to a clamping position, wherein the clamping claw is closer to a center axis of the fixing collar in the lead-in position than in the clamping position, and wherein the clamping claw is held by the guide in the clamping position.

7. An apparatus comprising the device of claim 1 and the faucet body or extension, the bottom end of the faucet body or extension being sized to fit around the fixing collar when the fixing collar is not expanded.

8. The apparatus according to claim 7, wherein the faucet body or extension has a bottom end with an aperture through which means for expanding can be actuated.

9. The apparatus according to claim 8, further comprising means for actuating the means for expanding.

10. The apparatus according to claim 9, wherein the means for actuating comprises a screw.

11. A method for fixing a faucet to a mounting comprising the steps of:

(a) providing the apparatus of claim 7;

(b) fixing the fixing collar to the top surface of the mounting by tightening the first fastening element or elements from above the mounting;

(c) disposing the bottom end of the faucet body or the extension thereof around the fixed fixing collar; and (d) actuating the fixing collar to cause the outer surface thereof to expand and press against an inner surface of the faucet body or extension.

12. The method according to claim 11, wherein the first fastening element or elements comprise at least one set screw and the means comprises (i) a clamping claw that is engageable with threading of the at least one set screw and (ii) a guide extending downward from the fixing collar for preventing rotation of the clamping claw when the at least one set screw rotates, wherein the at least one set screw, the clamping claw and the guide are disposed such that the turning of the at least one set screw causes the clamping claw to be raised and steered by the guide and wherein the fixing in step (b) comprises fixing the fixing collar to the top surface of the mounting by turning the at least one set screw from above the mounting.

13. The method according to claim 12, wherein step (b) consists of fixing the fixing collar to the top surface of the mounting by tightening the fastening elements from above the mounting.

* * * * *